US010653903B2

(12) United States Patent
Jones et al.

(10) Patent No.: US 10,653,903 B2
(45) Date of Patent: May 19, 2020

(54) ENERGY ABSORBER ARRANGEMENT AND FALL ARREST DEVICE

(71) Applicant: Latchways Plc, Devizes (GB)

(72) Inventors: Owain Jones, Chippenham (GB); Karl Jones, Devizes (GB)

(73) Assignee: Latchways Plc, Devizes (GB)

( * ) Notice: Subject to any disclaimer, the term of this patent is extended or adjusted under 35 U.S.C. 154(b) by 4 days.

(21) Appl. No.: 15/546,777

(22) PCT Filed: Jan. 27, 2016

(86) PCT No.: PCT/GB2016/050172
§ 371 (c)(1),
(2) Date: Jul. 27, 2017

(87) PCT Pub. No.: WO2016/120614
PCT Pub. Date: Aug. 4, 2016

(65) Prior Publication Data

US 2018/0015312 A1 Jan. 18, 2018

(30) Foreign Application Priority Data

Jan. 28, 2015 (GB) ..... 1501378.2

(51) Int. Cl.
*A62B 35/04* (2006.01)
*A62B 35/00* (2006.01)

(52) U.S. Cl.
CPC ..... *A62B 35/04* (2013.01); *A62B 35/0093* (2013.01)

(58) Field of Classification Search
CPC ..... A62B 35/00; A62B 35/04; A62B 35/0068; A62B 1/06; A62B 1/08; A62B 1/10; A62B 1/12; F16F 7/087; E04G 21/329; E04G 21/3204
See application file for complete search history.

(56) References Cited

U.S. PATENT DOCUMENTS 2,990,131 A * 6/1961 Carlsson ..... A62B 35/0093 182/237
3,595,528 A * 7/1971 Virkki ..... A62B 1/12 182/238
3,760,910 A * 9/1973 Koshihara ..... A62B 35/0093 182/237
3,802,540 A * 4/1974 Preston ..... F16D 13/12 192/12 BA
3,879,016 A * 4/1975 Kankkunen ..... A62B 1/10 182/238

(Continued)

FOREIGN PATENT DOCUMENTS

CN 2042362 U 8/1989
EP 0605538 B1 4/1996

(Continued)

*Primary Examiner* — Katherine W Mitchell
*Assistant Examiner* — Shiref M Mekhaeil
(74) *Attorney, Agent, or Firm* — The Webb Law Firm

(57) ABSTRACT

A fall arrest device having a rotatable drum with a safety line thereon, the fall arrest device comprising at least one energy absorber ring configured to absorb energy in the event of a fall and positioned to a side of the drum and between a first component configured to rotate with the drum and a second component configured to activate based upon the speed of rotation of the drum.

17 Claims, 8 Drawing Sheets

(56) References Cited

U.S. PATENT DOCUMENTS 4,446,884 A * 5/1984 Rader, Jr. ..... B65H 75/38 137/355.23
4,489,919 A * 12/1984 Ostrobrod ..... A62B 35/0093 182/232
4,511,123 A * 4/1985 Ostrobrod ..... A62B 35/0093 182/234
4,567,963 A * 2/1986 Sugimoto ..... A62B 1/08 182/231
4,640,388 A * 2/1987 Walborn ..... A62B 1/10 182/231
4,846,313 A * 7/1989 Sharp ..... A62B 35/0093 188/187
5,186,289 A * 2/1993 Wolner ..... A62B 1/12 182/232
5,217,084 A * 6/1993 Olson ..... A62B 1/10 182/234
5,343,976 A * 9/1994 Ostrobrod ..... A62B 1/06 182/237
5,351,906 A * 10/1994 Feathers ..... A62B 1/10 182/237
5,722,612 A * 3/1998 Feathers ..... A62B 35/0093 192/103 C
5,829,548 A * 11/1998 Ostrobrod ..... E06C 7/18 182/18
7,281,620 B2 * 10/2007 Wolner ..... A62B 1/10 192/223.1
7,484,696 B2 * 2/2009 Kim ..... E04G 21/185 138/89
8,181,744 B2 * 5/2012 Parker ..... A62B 1/10 182/232
8,385,024 B2 * 2/2013 Schmidt ..... G11B 5/4813 360/265.6
8,485,752 B2 * 7/2013 Slayne ..... F16C 23/04 360/265.2
8,701,833 B2 * 4/2014 Marquardt ..... A62B 1/10 182/231
8,950,551 B2 * 2/2015 Jones ..... A62B 35/0093 182/231
9,062,700 B2 * 6/2015 Pennsiriwongse ..... F16B 17/00
9,074,637 B2 * 7/2015 Slayne ..... G11B 5/4813
9,121,462 B2 * 9/2015 Casebolt ..... A62B 1/10
9,670,980 B2 * 6/2017 Jones ..... A62B 35/04
2002/0179372 A1 * 12/2002 Schreiber ..... A62B 1/10 182/238
2005/0224616 A1 * 10/2005 Xiaolin ..... A62B 1/10 242/286
2009/0178887 A1 * 7/2009 Reeves ..... A62B 1/10 182/239
2009/0223744 A1 * 9/2009 Dowie ..... A62B 35/0093 182/234
2010/0308149 A1 * 12/2010 Allington ..... A62B 1/08 242/379
2011/0076096 A1 * 3/2011 Slayne ..... F16C 27/02 403/372
2011/0278095 A1 11/2011 Hetrich et al.
2012/0067670 A1 * 3/2012 Rinklake ..... E06C 7/186 182/234
2012/0118670 A1 * 5/2012 Olson ..... A62B 1/10 182/232
2013/0248291 A1 * 9/2013 Jones ..... A62B 1/10 182/241
2014/0138186 A1 * 5/2014 Macy ..... A62B 35/0093 182/237
2014/0251731 A1 * 9/2014 Jones ..... A62B 35/04 182/231
2017/0252591 A1 * 9/2017 Hetrich ..... A62B 35/0093

FOREIGN PATENT DOCUMENTS

EP 1282460 B1 6/2007
WO 9501815 A2 1/1995
WO 9519203 A1 7/1995
WO 2005025678 A1 3/2005
WO 2008007119 A1 1/2008
WO 2009047541 A2 4/2009
WO 2013061087 A2 5/2013

* cited by examiner

ENERGY ABSORBER ARRANGEMENT AND FALL ARREST DEVICE

CROSS REFERENCE TO RELATED APPLICATIONS

This application is the United States national phase of International Application No. PCT/GB2016/050172 filed Jan. 27, 2016, and claims priority to United Kingdom Patent Application No. 1501378.2 filed Jan. 28, 2015 the disclosures of which are hereby incorporated in their entirety by reference.

BACKGROUND OF THE INVENTION

Field of the Invention

The present invention relates generally to a fall arrest system energy absorber and fall arrest device, and in particular to a fall arrest device including an energy absorber arrangement to absorb the energy during a fall arrest event.

Description of the Related Art

Fall arrest systems are used to prevent personnel working at heights from suffering injury as a result of falling or other such events. Fall arrest systems are often referred to as height safety systems or fall protection systems. Frequently such systems utilize an energy absorber device operable to be activated if a load above a predetermined threshold is applied. The energy absorber devices can take many forms, such as fabric rip devices, friction brake devices, or plastically deformable arrangements that are plastically deformed during deployment in order to absorb energy.

One type of device that relies on an energy absorber is a "safety block," which is arranged to be suspended overhead from an anchor structure. Such arrangements typically include a drum upon which a safety line is wound, a speed responsive mechanism arranged to inhibit the drum rotation above a predetermined rotational speed, and an energy absorber device arranged to be deployed if a load above a predetermined threshold is encountered when the speed responsive mechanism is deployed. Exemplary arrangements are disclosed in International Application Publication Nos. WO2009/047541 and WO2008/007119.

Another type of fall arrest or fall safety device is shown and described in International Application Publication No. WO95/01815, which discloses a device for use with a lanyard, and includes an energy absorber, and is used to connect between a user's harness and an anchor point for the lanyard.

Another type of fall arrest or fall safety device is an energy absorbing anchor post, such as the arrangement shown and described in European Patent No. EP1282460. This system is, for example, suitable for use in cable-based fall arrest systems anchored to structures, such as roofs. The cable needs to be held well clear of the roof surface to permit fall arrest system users to travel unimpeded along the cable. The casing of the post enables this to be achieved. A coiled plastically-deformable energy absorber is disclosed in European Patent No. EP1282460.

An example of a further alternative embodiment of safety device for a fall protection system is shown and described in European Patent No. EP0605538. This system is, for example, suitable for use in a safety line system to absorb sudden impact loadings and absorb impulse or shock energy. As with those discussed above, this system utilizes an energy absorber device, but, in this instance, it absorbs energy as two components move translationally or linearly relative to one another rather than rotationally, as in the previously described prior art examples. In the primary described embodiment in European Patent No. EP0605538, movement of a rod causes a retaining nut to be forced along a sleeve to permanently outwardly plastically deform the sleeve. The plastic deformation of the sleeve absorbs the energy.

International Application Publication No. WO2013/061087 discloses an arrangement in which an energy absorber arrangement comprises a resilient element providing an interference fit between a first component of the device and a second component of the device. Typically, this one component may comprise a rotating component, which is mounted about another component of the device, such as a hub or shaft.

SUMMARY OF THE INVENTION

Accordingly and generally, provided are an improved energy absorber arrangement and fall arrest device.

According to one preferred and non-limiting embodiment or aspect, provided is a fall arrest device comprising a drum for winding a safety line; an energy absorber ring configured to absorb energy in the event of a fall and facilitating an interference fit between a first component of the device and a second component of the device; and a speed responsive engagement arrangement responsive to the speed of rotation of the drum and configured to deploy to enable relative rotation of the first and second components, wherein the energy absorber ring is mounted to one side of and coaxially with the drum.

The drum can be of any size and the term "drum," for the purposes of definition, may be used interchangeably with spool, reel, bobbin, and/or other device upon which a safety line can be wound. Similarly, the "safety line" may be in the form of a cable, a line, a filament, a strap, webbing, a belt, or any other product or material that can be used as a safety line.

In one preferred and non-limiting embodiment or aspect, the first component comprises a mounting collar (or boss) to which the energy absorber ring is mounted. In another preferred and non-limiting embodiment or aspect, the mounting collar (or boss) is provided or positioned to one side of the drum, and is arranged to rotate with the drum. Accordingly, the size of the collar (or boss) and energy absorber ring may be made independent of the size of the drum, or a shaft to which the drum is mounted. Further, the ease and accuracy of the fitting of the energy absorber and components is also maximised.

In one preferred and non-limiting embodiment or aspect, the second component comprises a part of the speed responsive engagement arrangement. Further, the second component may comprise a pawl carrier carrying one or more movable pawls. In one preferred and non-limiting embodiment or aspect, the pawl carrier has a central aperture which is fitted to the energy absorber ring. In another preferred and non-limiting embodiment or aspect, the one or more pawls are biased to a home position, preferably in which the radial extent of the pawls is at a minimum. When deployed against the biasing force, the pawls preferably extend to a maximum distance radially outwardly, preferably such that a pawl is caused to engage a stationary component and inhibit rotation of the drum.

In one preferred and non-limiting embodiment or aspect, seals are provided at opposing sides of the energy absorber ring. These seals may be o-ring seals.

In one preferred and non-limiting embodiment or aspect, the mounting collar (or boss) for the energy absorber ring includes a seat (such as a shoulder) for seating the energy absorber ring and a first o-ring seal at one side of the energy absorber ring, and the second component (for example, the pawl carrier) includes a seating surface for the first o-ring seal and a second seating surface for seating a second o-ring seal, spaced from the first o-ring seal at the other side of the energy absorber ring. In another preferred and non-limiting embodiment or aspect, the device includes a closure or plug fitting into the device and having a flange or lip securing against the second o-ring.

In one preferred and non-limiting embodiment or aspect, the pawls, when deployed, engage with a component comprising or fixed to the chassis or frame of the device.

In one preferred and non-limiting embodiment or aspect, provided is a fall arrest device comprising a drum for winding a safety line, and a speed responsive engagement arrangement responsive to the speed of rotation of the drum and configured to deploy to inhibit rotation of the drum, wherein the speed responsive engagement arrangement comprises a pawl carrier configured to be rotatable with the drum, the pawl carrier carrying one or more rotatably-mounted engagement pawls, each pawl biased by a respective biasing element, which is positioned radially outwardly of the rotatable mounting of the pawl.

In one preferred and non-limiting embodiment or aspect, provided is a fall arrest device comprising an energy absorber ring configured to absorb energy in the event of a fall or other impulse event, wherein the energy absorber ring facilitates an interference fit between a first component of the device to which the ring is fitted and a second component of the device which fits over the ring, wherein the first component includes a seat (such as a shoulder) for seating the energy absorber ring and a first o-ring seal at one side of the energy absorber ring, and the second component includes a seating surface for the first o-ring seal and a second seating surface for seating a second o-ring seal, spaced from the first o-ring seal, at the other side of the energy absorber ring.

In one preferred and non-limiting embodiment or aspect, provided is a fall arrest device comprising a drum mounted for rotation, a speed responsive engagement mechanism responsive to the speed of rotation of the drum, which is activated at or above a predetermined rotational speed of the drum, and an energy absorber ring acting as an energy absorber arrangement to absorb energy and slow the rotation of the safety line drum when the speed responsive engagement mechanism is activated.

In one preferred and non-limiting embodiment or aspect, the resilient energy absorber ring provides or facilitates an interference fit between a rotational component of the device and another component of the device, and is configured or arranged to permit relative rotational motion of the connected components when a predetermined threshold torque level is reached, attained, and/or applied. In one preferred and non-limiting embodiment or aspect, the device further comprises a re-winding or re-spooling mechanism to rotate the drum to rewind the safety line onto the drum in the absence of sufficient tension in the safety line to pay out the line.

In one preferred and non-limiting embodiment or aspect, provided is a fall arrest device having a rotatable drum with a safety line thereon, the fall arrest device comprising at least one energy absorber ring configured to absorb energy in the event of a fall and positioned to a side of the drum and between a first component configured to rotate with the drum and a second component configured to activate based upon the speed of rotation of the drum.

In one preferred and non-limiting embodiment or aspect, the first component comprises at least one of the following: a portion of a shaft configured to rotate with the drum, a component directly or indirectly connected to a shaft configured to rotate with the drum, a component directly or indirectly connected to the drum, or any combination thereof.

In one preferred and non-limiting embodiment or aspect, the first component comprises a mounting collar having a seat configured to receive at least a portion of the at least one energy absorber ring. In another preferred and non-limiting embodiment or aspect, the fall arrest device further comprises at least one seal configured to seal the at least one energy absorber ring between at least a portion of the first component and at least a portion of the second component. In another preferred and non-limiting embodiment or aspect, the at least one seal is at least one o-ring seal.

In one preferred and non-limiting embodiment or aspect, the at least one seal comprises: an inner seal configured to seal an inner portion of the at least one energy absorber ring between an inner portion of the first component and an inner portion of the second component; and an outer seal configured to seal an outer portion of the at least one energy absorber ring between an outer portion of the first component and an outer portion of the second component. In another preferred and non-limiting embodiment or aspect, the fall arrest device further comprises a plug attached to at least a portion of the shaft, wherein the inner seal is positioned between a shoulder of the first component and a flange of the plug, thereby sealing the at least one energy absorber ring between the first component and the second component.

In one preferred and non-limiting embodiment or aspect, the at least one energy absorber ring is positioned coaxially with the drum.

In one preferred and non-limiting embodiment or aspect, the second component comprises a speed responsive engagement arrangement responsive to the speed of rotation of the drum and configured to activate to enable relative rotation between the first component and the second component. In another preferred and non-limiting embodiment or aspect, the speed responsive engagement arrangement comprises at least one movable pawl pivotally attached to a pawl carrier configured to rotate together with the drum.

In one preferred and non-limiting embodiment or aspect, the at least one movable pawl is configured to pivot from a home position to an activated position, wherein, in the activated position, the at least one pawl is configured to contact or engage a stop formation. In another preferred and non-limiting embodiment or aspect, the stop formation is at least one of attached to and integrally formed with a frame with respect to which the drum rotates. In another preferred and non-limiting embodiment or aspect, the at least one pawl is biased to the home position, wherein when the drum and the pawl carrier rotate at or over a specified speed, the bias is overcome and the at least one pawl moves to the activated position and contacts or engages the stop formation. In a further preferred and non-limiting embodiment or aspect, the bias is provided by a biasing spring positioned in a bore and configured to contact an end of the at least one pawl and urge the at least one pawl to the home position.

In one preferred and non-limiting embodiment or aspect, the pawl carrier comprises a central aperture forming a surface configured to contact and compress the at least one energy absorber ring. In another preferred and non-limiting embodiment or aspect, the at least one pawl comprises two pawls positioned on the pawl carrier and spaced from each other.

In one preferred and non-limiting embodiment or aspect, the at least one energy absorber ring comprises a plurality of projections configured to be compressed when the at least one energy absorber ring is positioned between the first component and the second component.

In one preferred and non-limiting embodiment or aspect, provided is a fall arrest device comprising: a frame configured for attachment to an anchor point; a drum having a safety line thereon and configured to rotate with respect to the frame, such that the safety line can be paid out from and retracted about the drum; and at least one energy absorber ring configured to absorb energy in the event of a fall and positioned to a side of the drum and between a first component configured to rotate with the drum and a second component configured to activate based upon the speed of rotation of the drum.

In one preferred and non-limiting embodiment or aspect, the first component comprises at least one of the following: a portion of a shaft configured to rotate with the drum, a component directly or indirectly connected to a shaft configured to rotate with the drum, a component directly or indirectly connected to the drum, or any combination thereof, and wherein the second component comprises a speed responsive engagement arrangement responsive to the speed of rotation of the drum and configured to activate to enable relative rotation between the first component and the second component.

In one preferred and non-limiting embodiment or aspect, the at least one energy absorber ring is positioned coaxially with the drum.

Further embodiments or aspects will now be described in the following numbered clauses.

Clause 1:

A fall arrest device, comprising: a drum for winding a safety line; an energy absorber ring configured to absorb energy in the event of a fall and facilitating an interference fit between a first component of the device and a second component of the device; and a speed responsive engagement arrangement responsive to the speed of rotation of the drum and configured to deploy to enable relative rotation of the first and second components, wherein the energy absorber ring is mounted to one side of and coaxially with the drum.

Clause 2:

The fall arrest device according to clause 1, wherein the first component comprises a mounting collar or boss to which the energy absorber ring is mounted.

Clause 3:

The fall arrest device according to clause 2 or 3 wherein the mounting collar or boss is provided to one side of the drum and is arranged to rotate with the drum.

Clause 4:

The fall arrest device according to any of clauses 1-3, wherein the second component comprises a part of the speed responsive engagement arrangement.

Clause 5:

The fall arrest device according to any of clauses 1-4, wherein the second component comprises a pawl carrier carrying one or more movable pawls.

Clause 6:

The fall arrest device according to any of clauses 1-5, wherein the pawl carrier has a central aperture which is fitted to the energy absorber ring.

Clause 7:

The fall arrest device according to any of clauses 1-6, wherein the one or more pawls are biased to a home position.

Clause 8:

The fall arrest device according to any of clauses 1-7, wherein the seals are provided at opposing sides of the energy absorber ring.

Clause 9:

The fall arrest device according to any of clauses 1-8, wherein the pawls, when deployed, engage with at least one component comprising the frame of the device.

Clause 10:

A fall arrest device, comprising: a drum for winding a safety line; and a speed responsive engagement arrangement responsive to the speed of rotation of the drum and configured to deploy to inhibit rotation of the drum, wherein the speed responsive engagement arrangement comprises a pawl carrier configured to be rotatable with the drum, the pawl carrier carrying one or more rotatably-mounted engagement pawls, each pawl biased by a respective biasing element, which is positioned radially outwardly of the rotatable mounting of the pawl.

Clause 11:

A fall arrest device, comprising an energy absorber ring configured to absorb energy in the event of a fall, wherein the energy absorber ring facilitates an interference fit between a first component of the device to which the ring is fitted and a second component of the device over which fits the ring, wherein the first component includes a seat configured to seat the energy absorber ring and a first o-ring seal at one side of the energy absorber ring, and the second component includes a seating surface for the first o-ring seal and a second seating surface for seating a second o-ring seal, spaced from the first o-ring seal, at the other side of the energy absorber ring.

Clause 12:

A fall arrest device according to clause 11, wherein the device includes at least one of a closure and plug fitting into the device and having at least one of a flange and lip configured to secure against the second o-ring.

Clause 13:

A fall arrest device having a rotatable drum with a safety line thereon, the fall arrest device comprising at least one energy absorber ring configured to absorb energy in the event of a fall and positioned to a side of the drum and between a first component configured to rotate with the drum and a second component configured to activate based upon the speed of rotation of the drum.

Clause 14:

The fall arrest device according to clause 13, wherein the first component comprises at least one of the following: a portion of a shaft configured to rotate with the drum, a component directly or indirectly connected to a shaft configured to rotate with the drum, a component directly or indirectly connected to the drum, or any combination thereof.

Clause 15:

The fall arrest device according to clause 13 or 14, wherein the first component comprises a mounting collar having a seat configured to receive at least a portion of the at least one energy absorber ring.

Clause 16:

The fall arrest device according to any of clauses 13-15, further comprising at least one seal configured to seal the at least one energy absorber ring between at least a portion of the first component and at least a portion of the second component.

Clause 17:

The fall arrest device according to any of clauses 13-16, wherein the at least one seal is at least one o-ring seal.

Clause 18:

The fall arrest device according to any of clauses 13-17, wherein the at least one seal comprises: an inner seal configured to seal an inner portion of the at least one energy absorber ring between an inner portion of the first component and an inner portion of the second component; and an outer seal configured to seal an outer portion of the at least one energy absorber ring between an outer portion of the first component and an outer portion of the second component.

Clause 19:

The fall arrest device according to any of clauses 13-18, further comprising a plug attached to at least a portion of the shaft, wherein the inner seal is positioned between a shoulder of the first component and a flange of the plug, thereby sealing the at least one energy absorber ring between the first component and the second component.

Clause 20:

The fall arrest device according to any of clauses 13-19, wherein the at least one energy absorber ring is positioned coaxially with the drum.

Clause 21:

The fall arrest device according to any of clauses 13-20, wherein the second component comprises a speed responsive engagement arrangement responsive to the speed of rotation of the drum and configured to activate to enable relative rotation between the first component and the second component.

Clause 22:

The fall arrest device according to any of clauses 13-21, wherein the speed responsive engagement arrangement comprises at least one movable pawl pivotally attached to a pawl carrier configured to rotate together with the drum.

Clause 23:

The fall arrest device according to any of clauses 13-22, wherein the at least one movable pawl is configured to pivot from a home position to an activated position, wherein, in the activated position, the at least one pawl is configured to contact or engage a stop formation.

Clause 24:

The fall arrest device according to any of clauses 13-23, wherein the stop formation is at least one of attached to and integrally formed with a frame with respect to which the drum rotates.

Clause 25:

The fall arrest device according to any of clauses 13-24, wherein the at least one pawl is biased to the home position, wherein when the drum and the pawl carrier rotate at or over a specified speed, the bias is overcome and the at least one pawl moves to the activated position and contacts or engages the stop formation.

Clause 26:

The fall arrest device according to any of clauses 13-25, wherein the bias is provided by a biasing spring positioned in a bore and configured to contact an end of the at least one pawl and urge the at least one pawl to the home position.

Clause 27:

The fall arrest device according to any of clauses 13-26, wherein the pawl carrier comprises a central aperture forming a surface configured to contact and compress the at least one energy absorber ring.

Clause 28:

The fall arrest device according to any of clauses 13-27, wherein the at least one pawl comprises two pawls positioned on the pawl carrier and spaced from each other.

Clause 29:

The fall arrest device according to any of clauses 13-28, wherein the at least one energy absorber ring comprises a plurality of projections configured to be compressed when the at least one energy absorber ring is positioned between the first component and the second component.

Clause 30:

A fall arrest device, comprising: a frame configured for attachment to an anchor point; a drum having a safety line thereon and configured to rotate with respect to the frame, such that the safety line can be paid out from and retracted about the drum; and at least one energy absorber ring configured to absorb energy in the event of a fall and positioned to a side of the drum and between a first component configured to rotate with the drum and a second component configured to activate based upon the speed of rotation of the drum.

Clause 31:

The fall arrest device according to clause 30, wherein the first component comprises at least one of the following: a portion of a shaft configured to rotate with the drum, a component directly or indirectly connected to a shaft configured to rotate with the drum, a component directly or indirectly connected to the drum, or any combination thereof, and wherein the second component comprises a speed responsive engagement arrangement responsive to the speed of rotation of the drum and configured to activate to enable relative rotation between the first component and the second component.

Clause 32:

The fall arrest device according to clause 30 or 31, wherein the at least one energy absorber ring is positioned coaxially with the drum.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various Figs. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise. Preferred features will be elucidated in the claims and in the specific description of the embodiments that follow. It will be readily appreciated that preferred features of certain aspects or embodiments could be usefully incorporated in other described embodiments even if not specifically described in those terms herein.

DETAILED DESCRIPTION OF THE INVENTION

Figure 2:
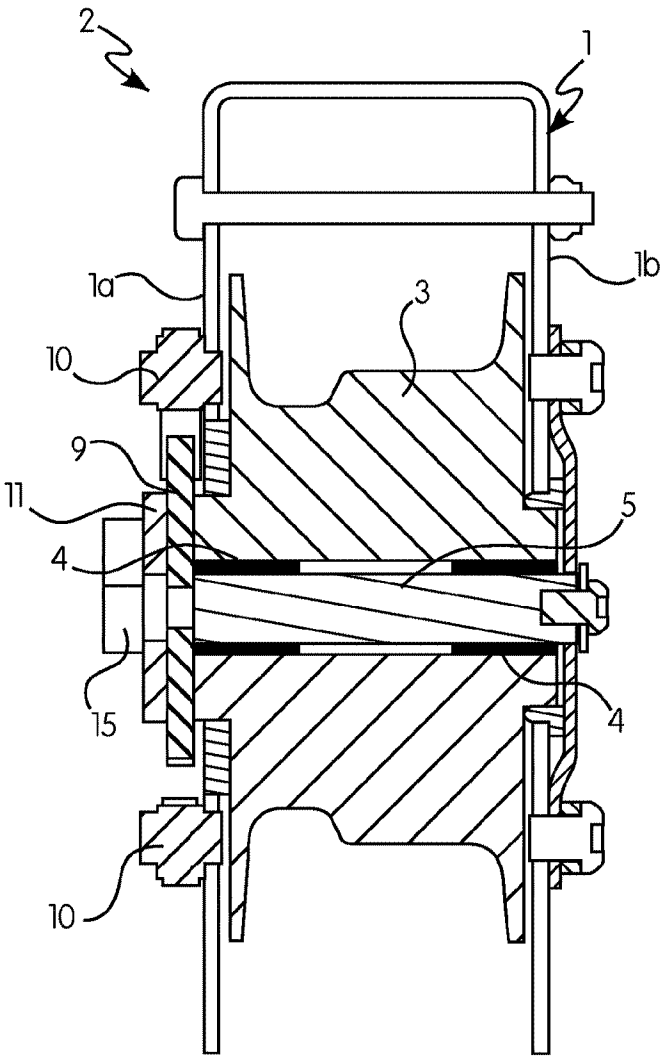
FIG. 2 (Prior Art)
FIG. 2 is a side sectional view of the fall arrest device of FIG. 1.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing Figs. However, it is to be understood that the invention may assume various alternative variations and step sequences, except where expressly specified to the contrary. It is also to be understood that the specific devices and processes illustrated in the attached drawings, and described in the following specification, are simply exemplary embodiments or aspects of the invention. Hence, specific dimensions and other physical characteristics related to the embodiments or aspects disclosed herein are not to be considered as limiting.

Referring to the drawings, and initially to FIGS. 1 to 4, there is shown a prior art fall arrest device 2, as disclosed in International Application Publication No. WO2013/061087. The device 2 has a U-shaped chassis frame body 1 having opposed chassis plates 1*a* and 1*b*. Between the chassis plates 1*a* and 1*b* is mounted a shaft 5 and a rotary drum 3 mounted and configured to rotate in unison with the shaft 5 through the use of a pair of spaced energy absorber rings 4 provided at each end of the shaft 5.

Figure 5A:
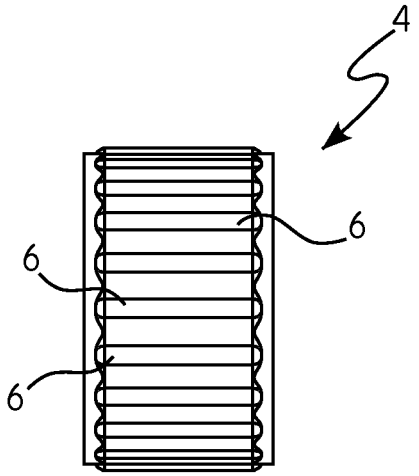
FIGS. 5A-C are perspective views of an energy absorber ring for a fall arrest device.
Figure 5C:
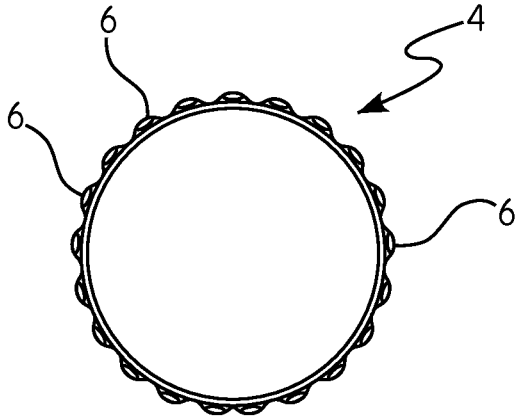
Figure 5B:
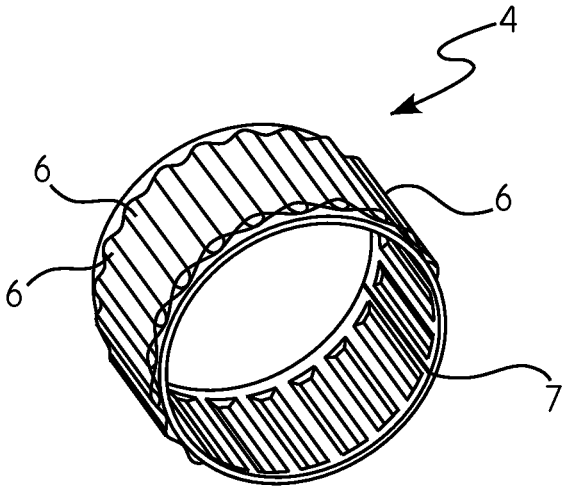

Typically, these energy absorber rings 4 are in the form of split-spring bands of resilient material, for example spring steel, the ends of which are brought towards one another to form a ring. An example of such an energy absorber ring 4, which may be referred to as a tolerance ring, is shown in FIGS. 5A-5C. A strip of projections 6 extends radially from the energy absorber ring 4—either outwardly from the center of the ring 4 (as shown) or inwardly towards the center of the ring 4 (in an alternate embodiment). The projections 6 can be formations, for example, evenly-spaced formations, such as corrugations, ridges, waves, and/or fingers. Further, the energy absorber ring 4 may include an unformed region from which the projections 6 extend, e.g. in a radial direction, and there may be two or more rows of projections 6. The energy absorber ring 4 may be split, such as at zone 7, as illustrated in FIG. 5B. Further, the strip of resilient material that forms the energy absorber ring 4 is curved to allow the easy formation of a ring, e.g. by overlapping the ends of the spring strip or band.

In use, the energy absorber rings 4 are located in the annular space between the shaft 5 and the drum 3, such that the projections 6 are compressed between the shaft 5 and drum 3. Typically, all of the projections 6 extend either outwardly or inwardly so that one of the shaft 5 and drum 3 abuts the projections 6 and the other abuts the unformed region. Each projection 6 acts as a spring and exerts a radial force against the shaft 5 and drum 3, thereby providing an interference fit between them. Rotation of the shaft 5 or drum 3 component will produce similar rotation in the other (such that they rotate in unison) as torque is transmitted by the energy absorber ring 4.

If torque is applied to one or both of the shaft 5 and drum 3, such that the resultant force between the components is above a threshold value, the inner and outer components can move relative to one another, i.e. the energy absorber ring 4 permits them to slip. Additionally, and beneficially, the energy absorber ring 4 is arranged to absorb energy in response to relative rotational movement between the shaft 5 and the drum 3.

During assembly of the device 2, including this interference fit between the shaft 5 and drum 3, the energy absorber ring 4 is typically held stationary with respect to a first (inner or outer) component (e.g., the shaft 5 or the drum 3) while the second component (e.g., the shaft 5 or the drum 3) is moved into mating engagement with the first component, thereby contacting and compressing the projections 6 of the energy absorber ring 4 to provide the interference fit. Once fitted, the energy absorber ring 4 remains in an energized state. The amount of force required to assemble the apparatus may depend on the stiffness of the projections 6 and the degree of compression required. Similarly, the load transmitted by the energy absorber ring 4 in its final position, and therefore the amount of retention/threshold force provided or torque that can be transmitted, may also depend on the size of the compression force and the stiffness and/or configuration of the projections 6.

Figure 3:
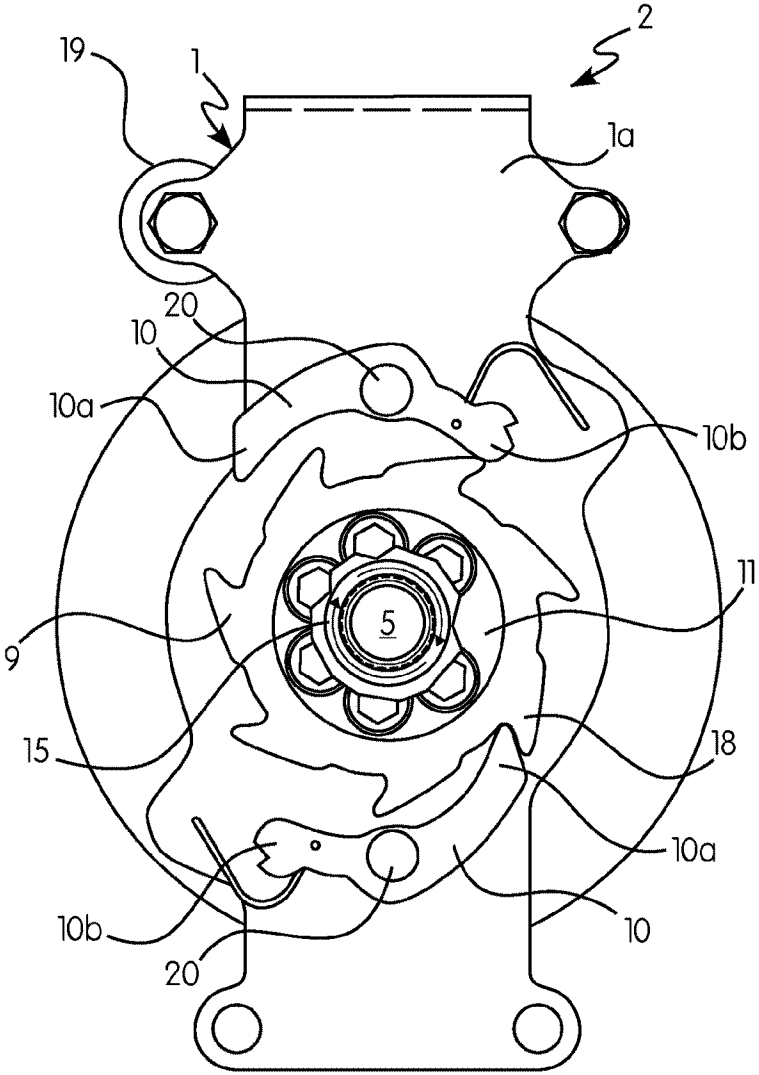
FIG. 3 (Prior Art)
FIG. 3 is a front view of fall arrest device according to the prior art.

As shown in FIG. 3, the device includes an attachment 19 for suspension from an anchor structure, as is known in the art. A safety line (not shown) is wound around the drum.

With continued reference to FIGS. 1-4, the device may include a rewinding or re-spooling mechanism, which is typically positioned adjacent and connected to the rotary drum 3. Such an arrangement is shown in, for example in International Application Publication Nos. WO2009/047541 and WO2008/007119. When a length of safety line is paid out from the drum 3 (causing rotation of the drum 3), the rewinding mechanism applies a small torque to the drum 3 causing it to rotate in the opposite direction, which tends to rewind the safety line back onto the drum 3. One preferred type of rewinding mechanism is a coiled spring, e.g., a clock-spring. Many suitable rewinding mechanisms are known in the art and will, therefore, not be described in detail herein. The use of such a rewinding mechanism ensures that, in normal use, the safety line paid out from the device as the user moves around has the slack to retract.

Figure 1:
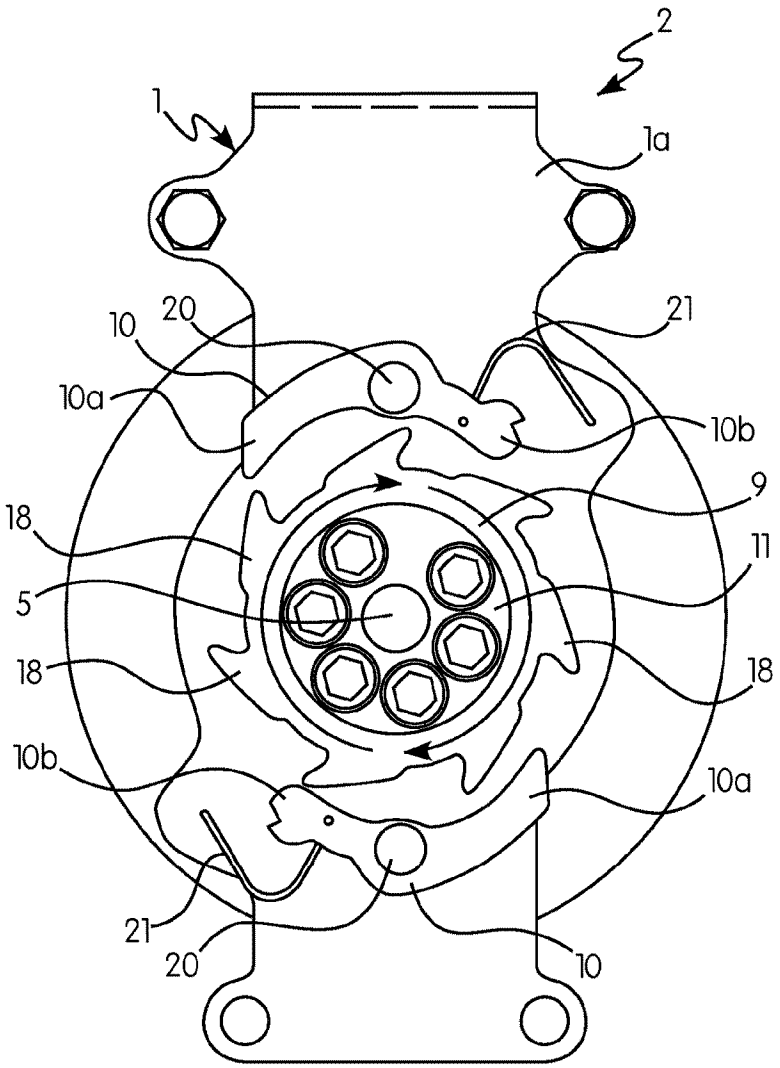
FIG. 1 (Prior Art)
FIG. 1 is a front view of a fall arrest device according to the prior art.
Figure 4:
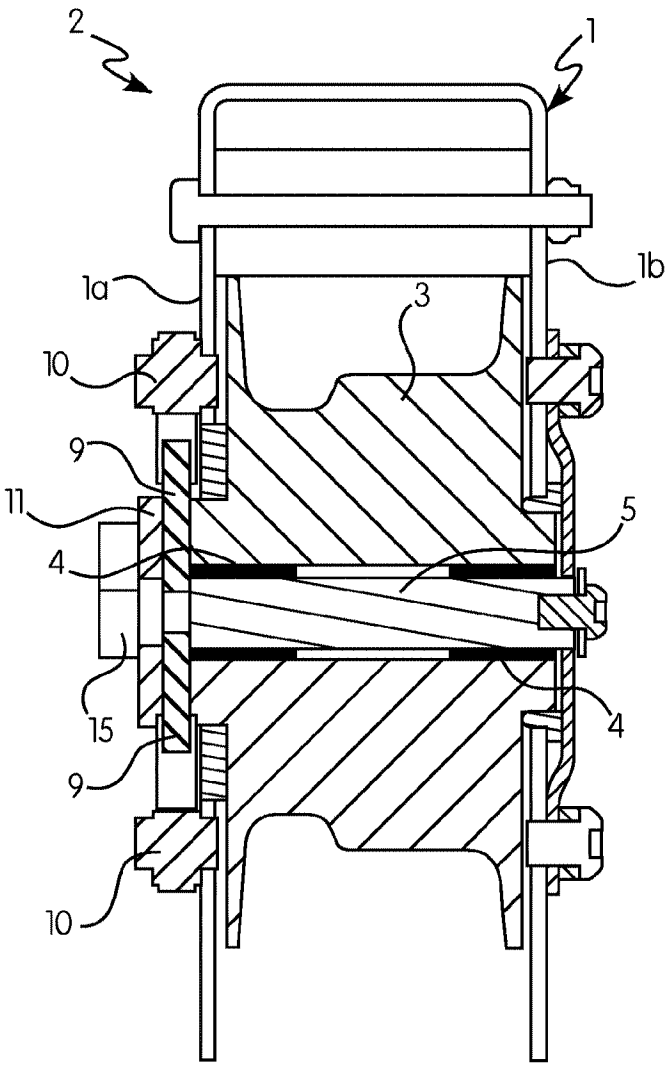
FIG. 4 (Prior Art)
FIG. 4 is a side sectional view of the fall arrest device of FIG. 3.

With continued reference to FIG. 1, also coupled to the drum 3, at its other side, is a speed responsive engagement arrangement, which includes pawls 10 and ratchet wheel 9. The pawls 10 and ratchet wheel 9 arrangement may, for example, be of a type similar to that described in International Application Publication No. WO2008/007119. The ratchet wheel 9 is mounted for rotation together with the shaft 5 through the use of a bolted plate 11 and a securing nut 15 (as shown in FIG. 2) positioned on an end of the shaft 5. The pawls 10 are secured to the chassis frame 1, in particular the chassis plate 1*a*, and mounted for pivotal movement about a pivot formation 20 on the chassis plate 1*a*. In particular, the pawls 10 can move pivotally between a first, disengaged position (shown in FIGS. 1 and 2), in which the ratchet wheel 9 and shaft 5 are able rotate relative to the fixed chassis frame 1, and a second, engaged position (as shown in FIGS. 3 and 4), where at least one of the pawls 10 is engaged with the ratchet wheel 9, such that further rotation of the ratchet wheel 9 and shaft 5 relative to the chassis frame 1 (in a first, typically clockwise, direction) is prevented.

At speeds of rotation of the drum 3 below a predetermined rate, the safety line is able to pay out freely from the drum 3. In this manner, and since the pawls 10 remain fixed to the chassis plate 1*a*, the ratchet wheel 9 rotates with the shaft 5 and drum 3, and the pawls 10 remain disengaged from teeth 18 of the ratchet wheel 9. This operation is described in detail in International Application Publication No. WO2008/007119. Accordingly, when the drum 3, the shaft 5, and the attached ratchet wheel 9 rotates in the first, clockwise, direction (as shown in FIG. 1), each tooth 18 of the ratchet wheel 9 in turn contacts a first (heel) end 10*b* of the pawl 10 and urges a second (toe) end 10*a* of the pawl 10 outward against the bias of the leaf spring 21. As a result, the pawls 10 follow an oscillating-type movement, but are not tripped to the engaged position.

The higher the speed of rotation of the drum 3, the shaft 5, and the ratchet wheel 9, the greater the amplitude of the oscillation of the pawl 10. When the speed of rotation of the drum 3, the shaft 5, and the ratchet wheel 9 rises to a threshold speed, the amplitude of the oscillation of the pawl 10 will be sufficient to trip or trigger the pawl 10 to the engaged position (as shown in FIGS. 3 and 4), thereby urging the second (toe) end 10*a* of the pawl 10 into contact with a tooth 18 of the ratchet wheel 9, thereby preventing further rotation of the drum 3, the shaft 5, and the ratchet wheel 9.

In a fall event, the safety line pays out from the drum 3 at a higher speed than it does during normal pay out situations. When the drum 3 rotational speed reaches the set predetermined threshold, the ratchet wheel 9 causes the pawl 10 to move (or "kick") out, such that the pivotally-mounted pawls 10 pivot about their pivot formations 20 beyond a tipping point, and become orientated to an engagement position in which the pawl 10 contacts and/or engages with the teeth 18 of the ratchet wheel 9. This operation is described in detail in International Application Publication No. WO2008/007119.

In the teeth-engaged position, the shaft 5 is effectively locked with respect to the chassis frame 1 and is prevented from further rotation. Accordingly, a relative torque differential is applied between the now-stationary shaft 5 and the drum 3, which is continuing to tend to rotate due to the force applied by the safety line paying out during the fall event. If the torque is above the design threshold of the connecting energy absorber ring 4, then relative rotation between the shaft 5 and the drum 3 will be permitted; however, the rotation of the drum 3 will be slowed (eventually to a stop) due to the energy-absorbing braking effect of the energy absorber ring 4 interposed between the shaft 5 and drum 3. Depending upon the design characteristics of the energy absorber ring 4 and the shaft 5 and drum 3 dimensions, the pay out time to stop the drum 3 can be controlled to a desired result. The use of such an energy absorber ring 4 to couple the shaft 5 and drum 3 accordingly permits relative rotation when a predetermined torque differential is reached, and also provides an energy absorbing/braking effect, since the energy absorber ring 4 remains energized. When the applied torque reduces back to a lower level, the further rotation of the drum 3 is stopped (i.e., the drum 3 and shaft 5 become re-coupled by the energy absorber ring 4).

Figure 8:
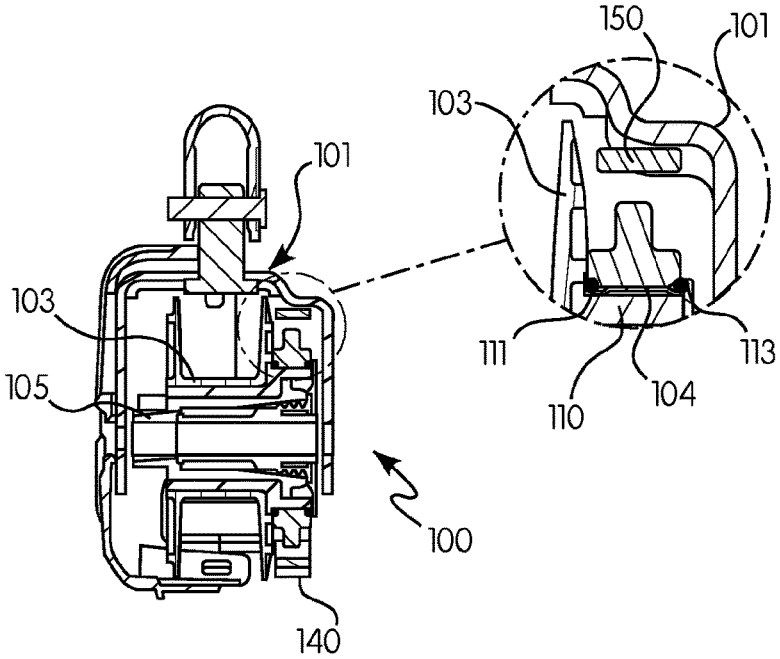
FIG. 8 is a side sectional view of the fall arrest device of FIG. 7 along section lines A-A.

In one preferred and non-limiting embodiment or aspect, the present invention is directed to a fall arrest device 100, as illustrated in FIGS. 6-12. The device 100 includes a drum 103 around which a safety line (not shown) is wound. The drum 103 is mounted to a rotary shaft 105, as illustrated in FIG. 8. In one preferred and non-limiting embodiment or aspect, the shaft 105 and drum 103 are mounted such that they rotate together (i.e., they are rotationally fixed with respect to each other). Accordingly, in this embodiment or aspect, the fall arrest device 100 does not utilize an energy absorber ring 4 between the drum 103 and the shaft 105.

Figure 10:
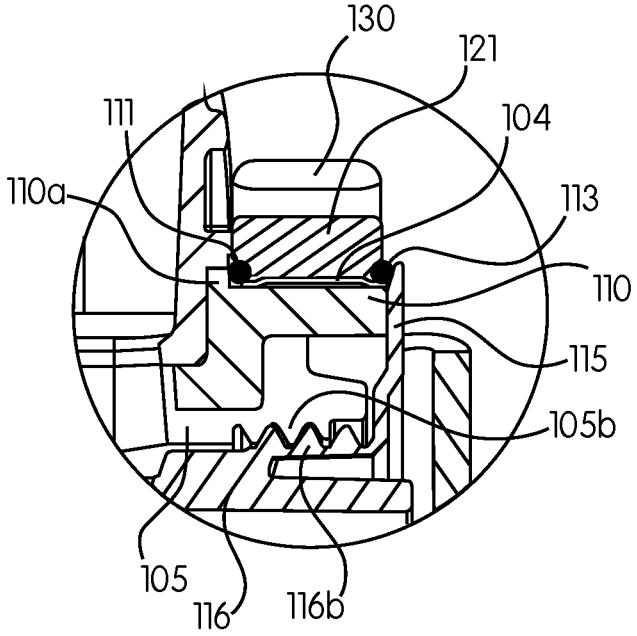
FIG. 10 is a detailed view of a portion of the fall arrest device of FIG. 9.
Figure 9:
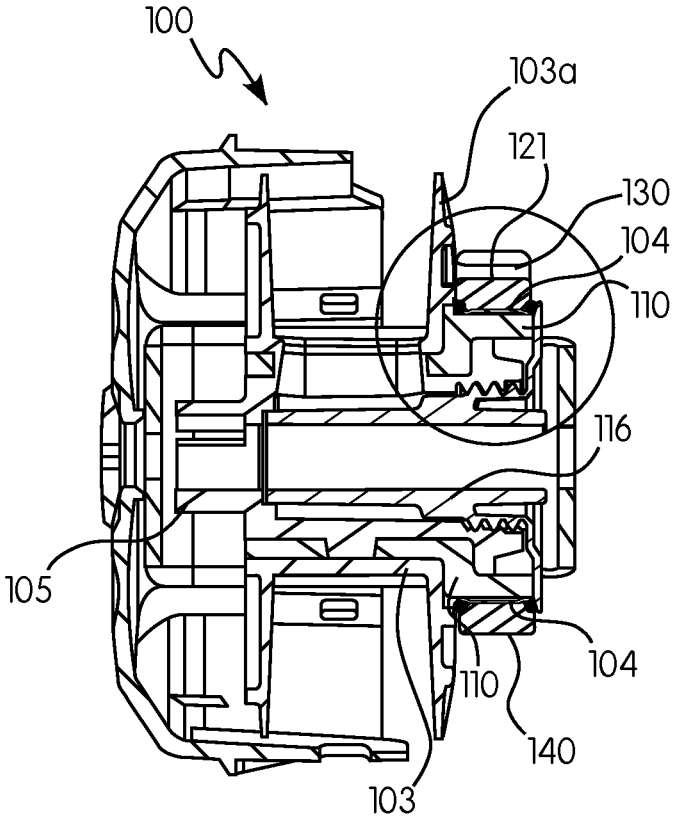
FIG. 9 is a further sectional view of the fall arrest device of FIG. 6.

In one preferred and non-limiting embodiment or aspect, and as best illustrated in FIGS. 9 and 10, a portion of the shaft 105 that extends outwardly from an outer wall 103*a* of the drum 103 includes or is in the form of a collar 110 to which is mounted an energy absorber ring 104. This collar 110 includes an inner shoulder 110*a*, which is configured to seat the energy absorber ring 104, together with an inner o-ring seal 111. An outer o-ring seal 113 is seated at an outer edge of the collar 110 through the use of a flange 115 of a sealing plug 116, which is attached to (e.g., screwed into) the shaft 105. For such a screw fit, and in one preferred and non-limiting embodiment or aspect, mating screw thread formations (or projections) 105*b* and 116*b* are provided on the shaft 105 and sealing plug 116, respectively.

In one preferred and non-limiting embodiment, a pawl carrier 121 is mounted by the energy absorber ring 104 to the collar 110, as shown most clearly in FIG. 9, such that, when fitted, the energy absorber ring 104 is energized. In particular, this is effectuated by providing an interference fit, such that the collar 110 and pawl carrier 121 effectively rotate together until an applied torque of a predetermined level is applied between the collar 110 and the pawl carrier 121.

During assembly of the fall arrest device 100, this interference fit is created between the pawl carrier 121, the energy absorber ring 104, and the collar 110. Before the sealing plug 116 is attached to the shaft 105, the inner o-ring seal 111 and the energy absorber ring 104 are positioned on the collar 110. With the energy absorber ring 104 held stationary, an inner bearing surface of the pawl carrier 121 is moved into mating engagement with and about the collar 110, thereby contacting and compressing projections 104*a* (see FIGS. 6 and 11) of the energy absorber ring 104 to provide the interference fit. Once fitted, the energy absorber ring 104 remains in an energized state, i.e., the projections 104*a* are compressed. The amount of force required to assemble the device 100 may depend upon the stiffness of the projections 104*a* and the degree of compression required. Similarly, the load transmitted by the energy absorber ring 104 in its final position, and hence the amount of retention/threshold force provided or torque that can be transmitted, may also depend on the size of the compression force and the stiffness and/or configuration of the projections 104*a*.

Once the pawl carrier 121 is fitted to the collar 110, the outer o-ring seal 113 is fitted and the sealing plug 116 is attached to the shaft 105 (e.g., screwed into mating engagement with the collar 110 of the shaft 105) to hold the outer o-ring seal 113 in place, and seal the shaft 105 and pawl carrier 121/collar 110 assembly. This arrangement enables the energy absorber ring 104 to be sealed against its surrounding components. In one preferred and non-limiting embodiment or aspect, the pawl carrier 121 includes inclined seal abutment surfaces to accommodate the o-ring seals 111 and 113.

Figure 6:
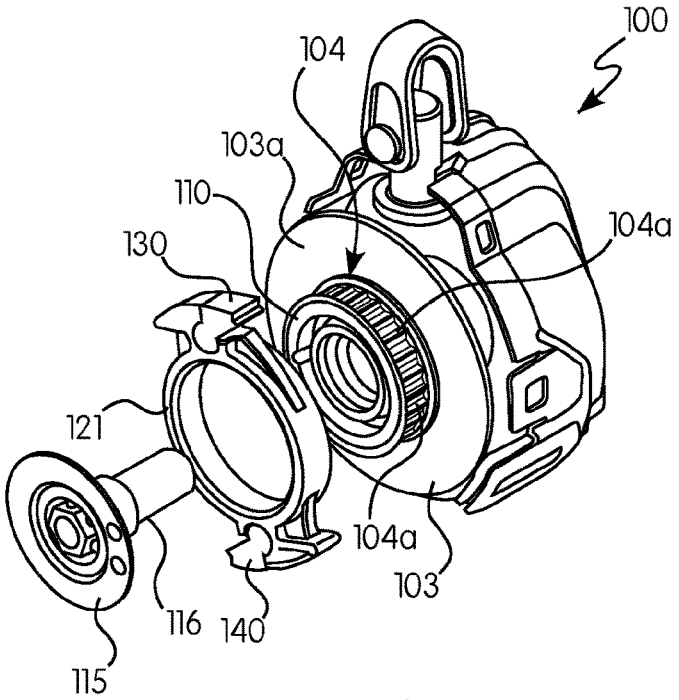
FIG. 6 is an exploded perspective view of a fall arrest device according to the principles of the present invention.
Figure 7:
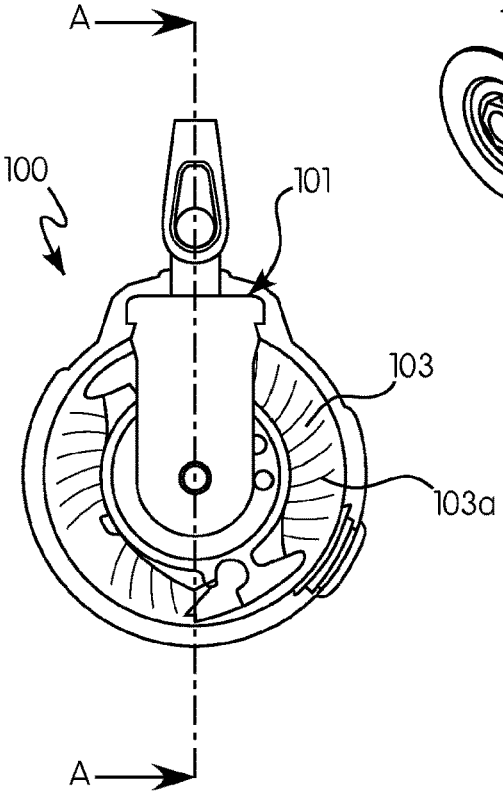
FIG. 7 is a side view of the fall arrest device of FIG. 6.
Figure 11:
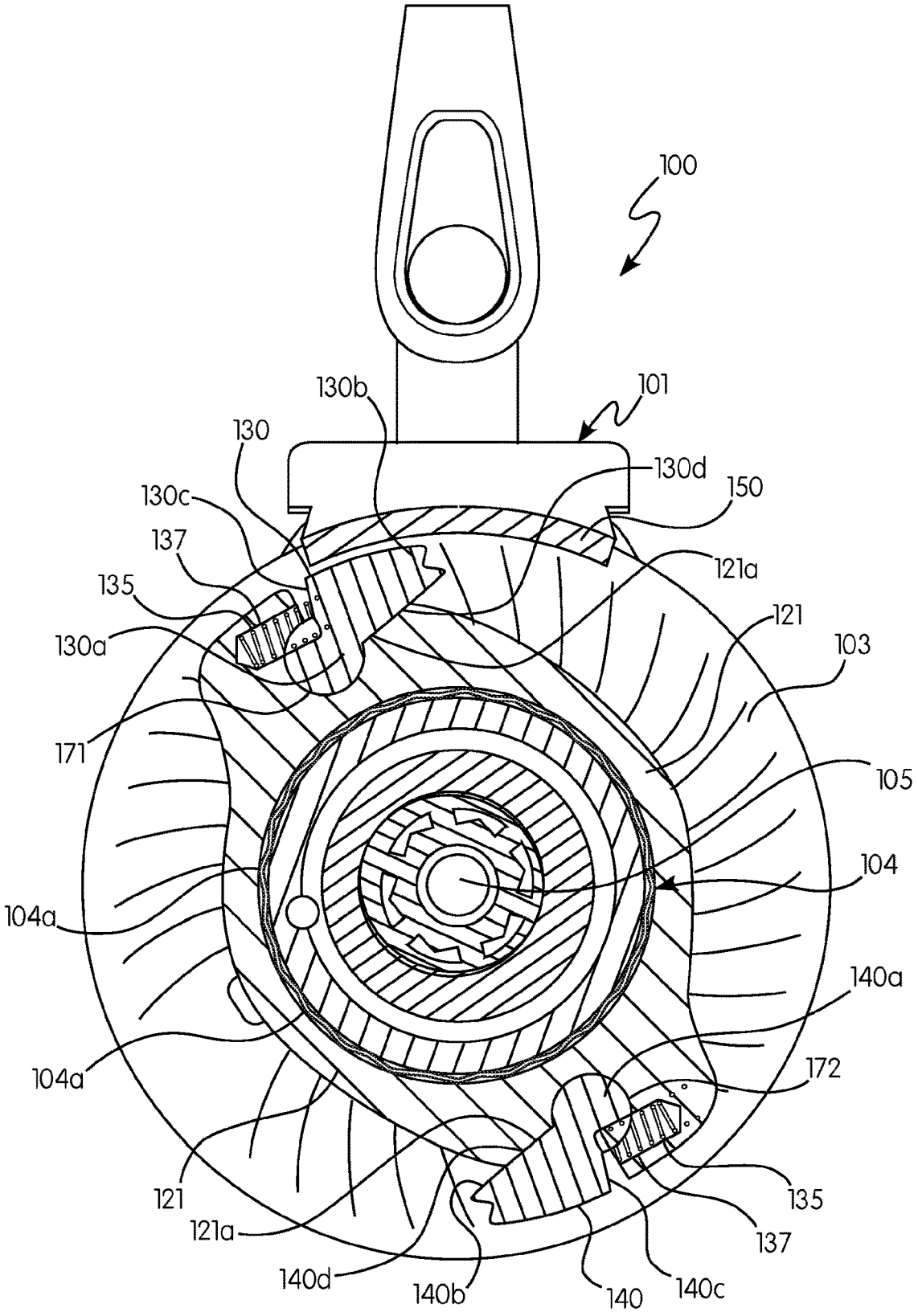
FIG. 11 is a schematic view of a fall arrest device according to the principles of the present invention in a mode of operation.
Figure 12:
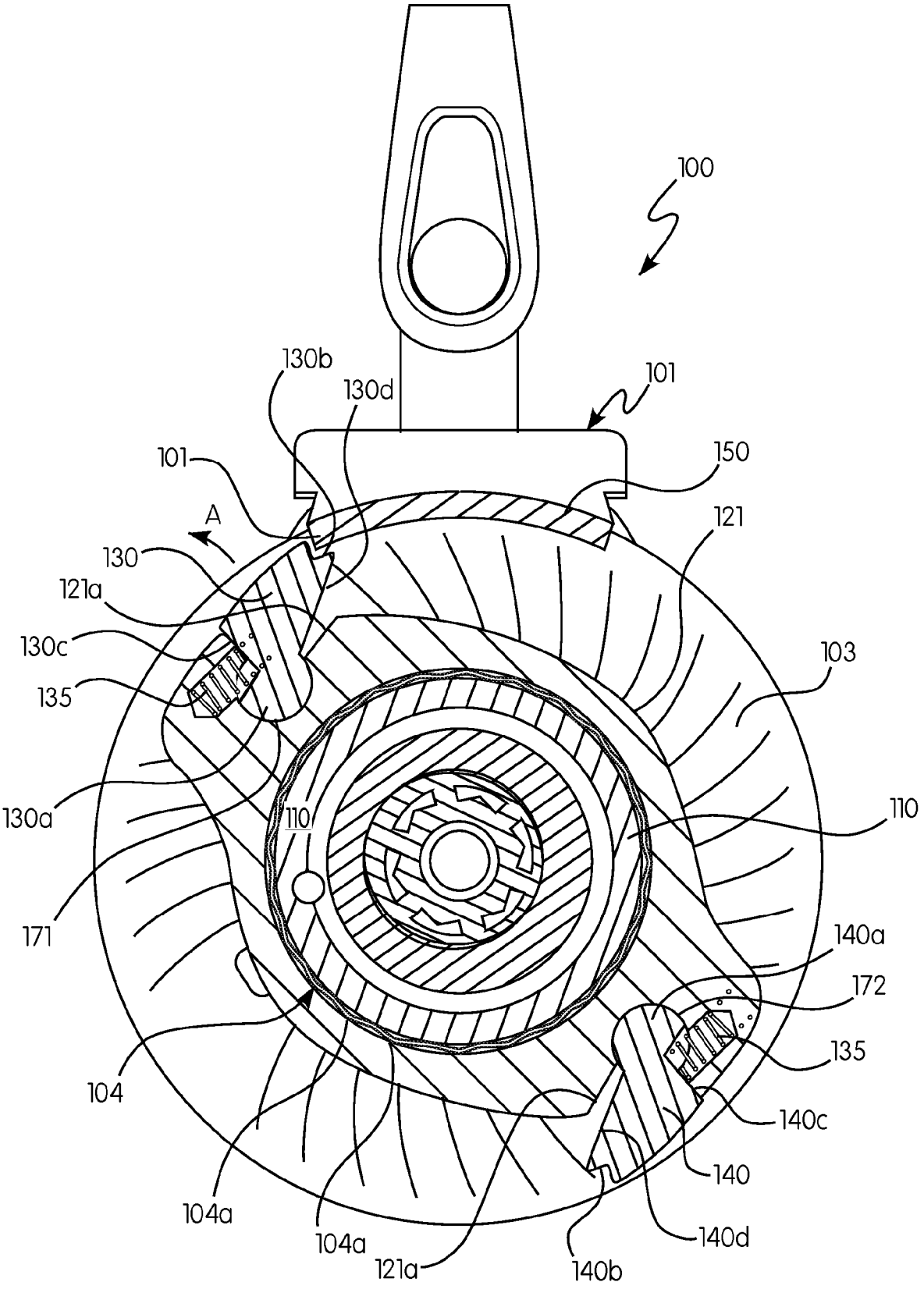
FIG. 12 is a schematic view of a fall arrest device according to the principles of the present invention in another mode of operation.

In one preferred and non-limiting embodiment or aspect, and as shown in FIGS. 6 and 9, the pawl carrier 121 includes a pair of (preferably 180°) spaced, pivotally-mounted pawls 130 and 140. As shown schematically in FIGS. 11 and 12, the pawls 130 and 140 each include or form a mounting boss 130*a* and 140*a* (which may be substantially and/or partly cylindrical in form) on an end thereof, wherein each mounting boss 130*a* and 140*a* is received in a respective seat 171 and 172 (which may correspondingly be substantially or partly cylindrical in form) of the pawl carrier 121. The pawls 130 and 140 are slid into the seats 171 and 172 in the direction of the rotational axis of the drum 103 and shaft 105. Further, the mounting bosses 130*a* and 140*a* are rotatable in the mounting seats 171 and 172 due to the presence of the (preferably cylindrical) bearing surfaces, between two extreme positions, as shown in FIGS. 11 and 12, respectively. The pawls 130 and 140 have an engagement end 130*b* and 140*b* spaced from the mounting bosses 130*a* and 140*a* and configured to engage with a stop formation 150 of the fall arrest device 100, as will be described hereinafter.

In one preferred and non-limiting embodiment, a biasing spring 135 is positioned in a bore 137 of the pawl carrier 121 and urges against an abutment surface 130*c* and 140*c*, respectively, of each pawl 130 and 140. In this manner, a contact face 130*d* and 140*d*, respectively, of each pawl 130 and 140 is urged or pushed to abut against a home surface 121*a* of the pawl carrier 121. The pawls 130 and 140 are, therefore, normally biased to the home position, as shown in FIG. 11, in which the contact face 130*d* and 140*d* of each pawl 130 and 140 is pushed to abut against the home surface 121*a* of the pawl carrier 121. In normal use (i.e., when the safety line is paid out from the device 100 during normal operation), the drum 103 and shaft 105 rotate together with the pawl carrier 121 since the pawls 130 and 140 remain in their home position, as shown in FIG. 11. The pawls 130 and 140 are, therefore, biased by the respective biasing springs 135, which, in one preferred and non-limiting embodiment or aspect, are positioned radially outwardly of the rotatable mounting boss 130*a* and 140*a* of the respective pawl 130 and 140. Such a unique arrangement leads to a less complex constructional arrangement of pawls than, for example, those used in an existing device, such as the device shown and described in International Application Publication No. WO2005/025678.

Figure 13:
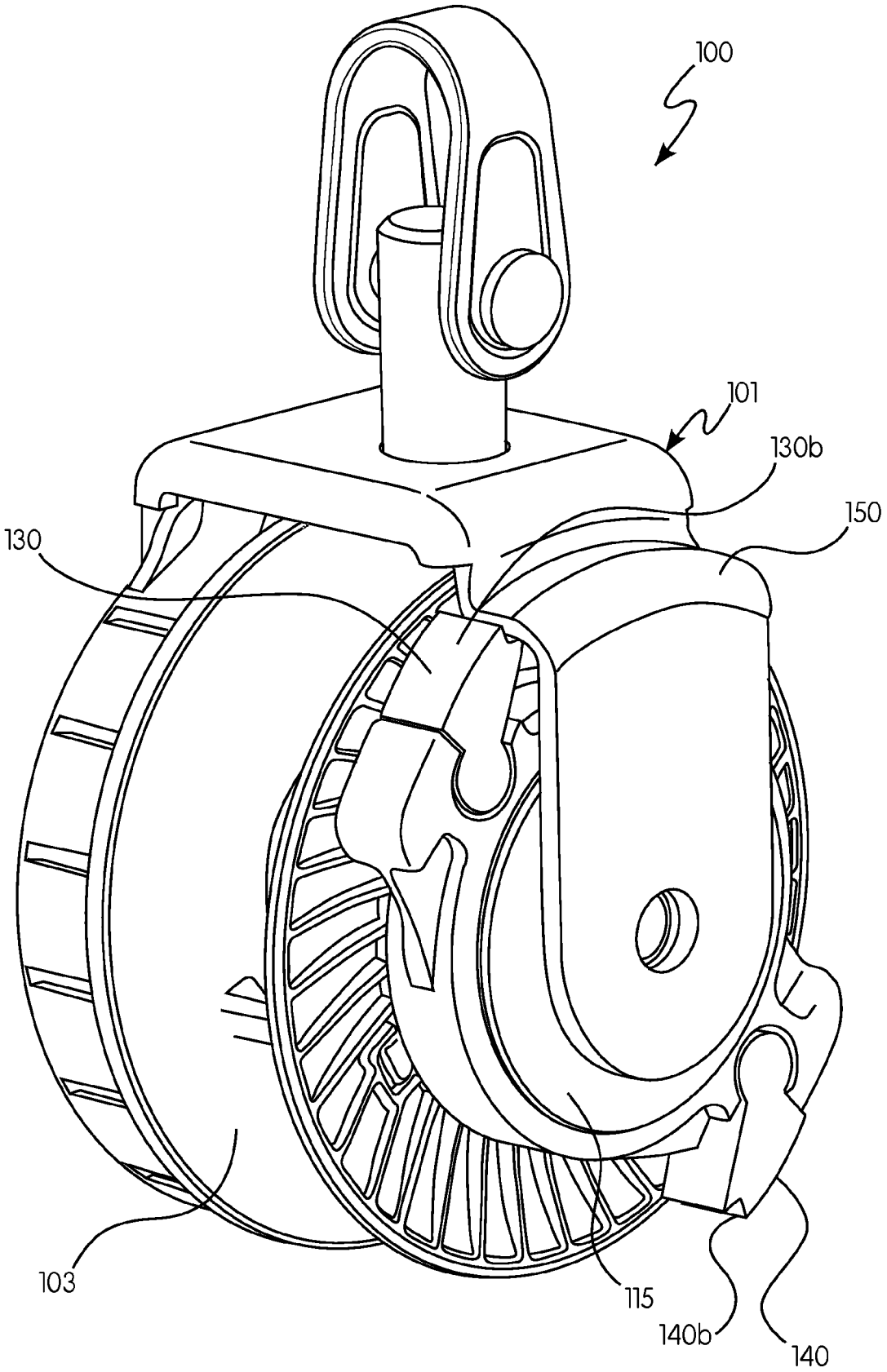
FIG. 13 is a perspective view of the fall arrest device of FIG. 12.

Upon an occurrence of a fall event, the safety line is paid out much more rapidly, which causes the pawls 130 and 140 to rotate (as indicated by arrow A in FIG. 12) against the biasing force of the biasing springs 135. When this happens, the biasing springs 135 and pawls 130 and 140 reconfigure or move to the activated position shown in FIGS. 12 and 13, in which the engagement ends 130*b* and 140*b* of the pawls 130 and 140 move radially outwardly and at least one of them will move into engagement with the stop formation 150 of the device 100. In one preferred and non-limiting embodiment or aspect, the stop formation 150 is attached to and/or or formed integrally with a chassis frame 101 of the device 100. Once this occurs, the pawl carrier 121 is locked against and fixed with respect to the chassis frame 101 (thus preventing further rotation) together with the shaft 105, the drum 103, and the collar 110. If the torque applied by the fall arrest event is sufficient, the drum 103, the shaft 105, and the collar 110 will tend to continue rotation. In this case, the energy absorber ring 104 will rotate with either the collar 110 or the pawl carrier 121, and the relative rotation of the other of either the collar 110 or the pawl carrier 121 with respect to the energy absorber ring 104 will ensure energy is absorbed until the fall is completely arrested.

One benefit of the present invention is based upon the positioning of the energy absorbing ring 104, i.e., the energy absorber ring 104 is not fitted between the shaft 105 and the drum 103, but instead between a rotary component spaced from the drum 103 (in one preferred and non-limiting embodiment or aspect, the collar 110) and a part of a speed responsive engagement device (in one preferred and non-limiting embodiment or aspect, the pawl carrier 121). Such an arrangement enables the energy absorber ring 104 to be effectively sealed to the ingress of moisture and other environmental contaminants, and also enables a larger diameter energy absorber ring 104 and mounting to be used, since the dimension of the energy absorber ring 104 is not limited to the shaft 105 diameter. Such an arrangement leads to benefits in terms of dimensional tolerance and also enabling selection of an appropriately-sized energy absorber ring 104 for the deployment torque to be accommodated. Accordingly, the present invention enables the size of the energy absorber ring 104 to be independent of the drum 103 and the shaft 105 dimensions. Further, having the energy absorber ring 104 mounted to the side of the shaft 105 also has benefits in terms of access to the energy absorber ring 104 and seals (e.g., inner o-ring seal 111 and outer o-ring seal 113) during assembly and maintenance.

The invention has been primarily described in terms of a device having the speed responsive engagement pawls 130 and 140 mounted to rotate with the drum 103 and shaft 105. However, it should be noted that this arrangement may be reversed with respect to the existing devices described above. While the embodiment described with respect to the invention is preferred technically, it will be readily appreciated that the invention could be realized by having the ratchet wheel of an existing device mounted to the collar 110, and pivoting engagement pawls mounted to the chassis.

Although the invention has been described in detail for the purpose of illustration based on what is currently considered to be the most practical and preferred embodiments or aspects, it is to be understood that such detail is solely for that purpose and that the invention is not limited to the disclosed embodiments or aspects, but, on the contrary, is intended to cover modifications and equivalent arrangements that are within the spirit and scope of the appended claims. For example, it is to be understood that the present invention contemplates that, to the extent possible, one or more features of any embodiment or aspect can be combined with one or more features of any other embodiment or aspect.

What is claimed is:

1. A fall arrest device having a rotatable drum with a safety line thereon, the fall arrest device comprising:

at least one energy absorber ring configured to absorb energy in the event of a fall, the at least one energy absorber ring being in an interference fit with a first component configured to rotate with the drum and a second component; and a speed responsive engagement arrangement responsive to the speed of rotation of the drum and configured to deploy to enable rotation of the first component relative to the second component, wherein the energy absorber ring is mounted to one lateral side of and coaxially with the drum.

2. The fall arrest device according to claim 1, wherein the first component comprises at least one of the following: a portion of a shaft configured to rotate with the drum, a component directly or indirectly connected to the shaft configured to rotate with the drum, or a component directly or indirectly connected to the drum.

3. The fall arrest device according to claim 2, wherein the first component comprises a mounting collar having a seat configured to receive at least a portion of the at least one energy absorber ring.

4. The fall arrest device according to claim 3, further comprising at least one seal configured to seal the at least one energy absorber ring between at least a portion of the first component and at least a portion of the second component.

5. The fall arrest device according to claim 4, wherein the at least one seal is at least one o-ring seal.

6. The fall arrest device according to claim 4, wherein the at least one seal comprises: an inner seal configured to seal an inner portion of the at least one energy absorber ring between an inner portion of the first component and an inner portion of the second component; and an outer seal configured to seal an outer portion of the at least one energy absorber ring between an outer portion of the first component and an outer portion of the second component.

7. The fall arrest device according to claim 6, further comprising a plug attached to at least the portion of the shaft, wherein the inner seal is positioned between a shoulder of the first component and a flange of the plug, thereby sealing the at least one energy absorber ring between the first component and the second component.

8. The fall arrest device according to claim 1, wherein the speed responsive engagement arrangement comprises at least one movable pawl pivotally attached to a pawl carrier configured to rotate together with the drum.

9. The fall arrest device according to claim 8, wherein the at least one movable pawl is configured to pivot from a home position to an activated position, wherein, in the activated position, the at least one pawl is configured to contact or engage a stop formation.

10. The fall arrest device according to claim 9, wherein the stop formation is at least one of attached to and integrally formed with a frame with respect to which the drum rotates.

11. The fall arrest device according to claim 9, wherein the at least one pawl is biased to the home position, wherein when the drum and the pawl carrier rotate at or over a specified speed, the bias is overcome and the at least one pawl moves to the activated position and contacts or engages the stop formation.

12. The fall arrest device according to claim 11, wherein the bias is provided by a biasing spring positioned in a bore and configured to contact an end of the at least one pawl and urge the at least one pawl to the home position.

13. The fall arrest device according to claim 8, wherein the pawl carrier comprises a central aperture forming a surface configured to contact and compress the at least one energy absorber ring.

14. The fall arrest device according to claim 8, wherein the at least one pawl comprises two pawls positioned on the pawl carrier and spaced from each other.

15. The fall arrest device according to claim 1, wherein the at least one energy absorber ring comprises a plurality of projections configured to be compressed when the at least one energy absorber ring is positioned between the first component and the second component.

16. A fall arrest device, comprising:

a frame configured for attachment to an anchor point;

a drum having a safety line thereon and configured to rotate with respect to the frame, such that the safety line can be paid out from and retracted about the drum;

at least one energy absorber ring configured to absorb energy in the event of a fall, the at least one energy absorber ring being in an interference fit with a first component configured to rotate with the drum and a second component; and a speed responsive engagement arrangement responsive to the speed of rotation of the drum and configured to deploy to enable rotation of the first component relative to the second component, wherein the energy absorber ring is mounted to one lateral side of and coaxially with the drum.

17. The fall arrest device according to claim 16, wherein the first component comprises at least one of the following: a portion of a shaft configured to rotate with the drum, a component directly or indirectly connected to the shaft configured to rotate with the drum, or a component directly or indirectly connected to the drum and wherein the second component comprises the speed responsive engagement arrangement.

* * * * *